US008718525B2

(12) United States Patent
Kikuchi

(10) Patent No.: US 8,718,525 B2
(45) Date of Patent: May 6, 2014

(54) FUSER FOR PREVENTING EXCESSIVE INCREASED TEMPERATURE IN PAPER PASSING REGION OF A HEAT TRANSFERRING PART

(75) Inventor: Kazuhiko Kikuchi, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 209 days.

(21) Appl. No.: 13/293,708

(22) Filed: Nov. 10, 2011

(65) Prior Publication Data

US 2012/0177419 A1 Jul. 12, 2012

Related U.S. Application Data

(60) Provisional application No. 61/431,382, filed on Jan. 10, 2011.

(51) Int. Cl.
*G03G 15/20* (2006.01)

(52) U.S. Cl.
USPC ..... 399/329

(58) Field of Classification Search
USPC ..... 399/329
See application file for complete search history.

(56) References Cited

U.S. PATENT DOCUMENTS

| | | | | |
|---|---|---|---|---|
| 7,720,424 | B2 * | 5/2010 | Yoda et al. | 399/335 |
| 2009/0142114 | A1 * | 6/2009 | Yasuda et al. | 399/333 |
| 2010/0215390 | A1 * | 8/2010 | Tomita et al. | 399/69 |
| 2011/0076043 | A1 | 3/2011 | Kikuchi et al. | |
| 2011/0135358 | A1 | 6/2011 | Kikuchi et al. | |
| 2011/0135359 | A1 | 6/2011 | Kikuchi et al. | |
| 2011/0217096 | A1 | 9/2011 | Kikuchi et al. | |

* cited by examiner

*Primary Examiner* — Walter L Lindsay, Jr.
*Assistant Examiner* — Frederick Wenderoth
(74) *Attorney, Agent, or Firm* — Patterson & Sheridan, LLP

(57) ABSTRACT

A fuser includes an endless heat generating part including a conductive layer, an induced current generating part to heat the conductive layer by electromagnetic induction, and a magnetic shunt metal member that is located at a side opposite to the induced current generating part across the heat generating part, forms a first gap between the magnetic shunt metal member and the heat generating part in a first paper passing region of the heat generating part, and forms a second gap, which is different from the first gap in size, between the magnetic shunt metal member and the heat generating part in a second paper passing region different from the first paper passing region.

18 Claims, 5 Drawing Sheets

FUSER FOR PREVENTING EXCESSIVE INCREASED TEMPERATURE IN PAPER PASSING REGION OF A HEAT TRANSFERRING PART

CROSS REFERENCE TO RELATED APPLICATION

This application is based upon and claims the benefit of priority from Provisional U.S. Application 61/431,382 filed on Jan. 10, 2011 the entire contents of which are incorporated herein by reference.

FIELD

Embodiments described herein relate generally to a fuser used in an image forming apparatus, and particularly to a fuser in which temperature of a heat generating part is uniformed.

BACKGROUND

As a fuser used in an image forming apparatus such as a copying machine or a printer, there is a fuser in which the heat capacity of a heat generating part is reduced, the energy is saved, and a quick temperature rise is achieved. The heat generating part having the small heat capacity is difficult to keep the surface temperature of the heat generating part uniformly in a direction perpendicular to the conveyance direction of a sheet.

In the heat generating part having the small heat capacity, heat transfer from the heat generating part to the sheet does not occur in a sheet non-passing region during fixation, and there is a fear that an abnormal increased temperature occurs. Because of the increased temperature of the sheet non-passing region, there is a fear that the image forming operation of the image forming apparatus must be placed in a stand-by state.

DETAILED DESCRIPTION

In general, according to one embodiment, a fuser includes an endless heat generating part including a conductive layer, an induced current generating part to heat the conductive layer by electromagnetic induction, and a magnetic shunt metal member that is located at a side opposite to the induced current generating part across the heat generating part, forms a first gap between the magnetic shunt metal member and the heat generating part in a first paper passing region of the heat generating part, and forms a second gap, which is different from the first gap in size, between the magnetic shunt metal member and the heat generating part in a second paper passing region different from the first paper passing region.

Hereinafter, embodiments will be described.

First Embodiment

Figure 1:
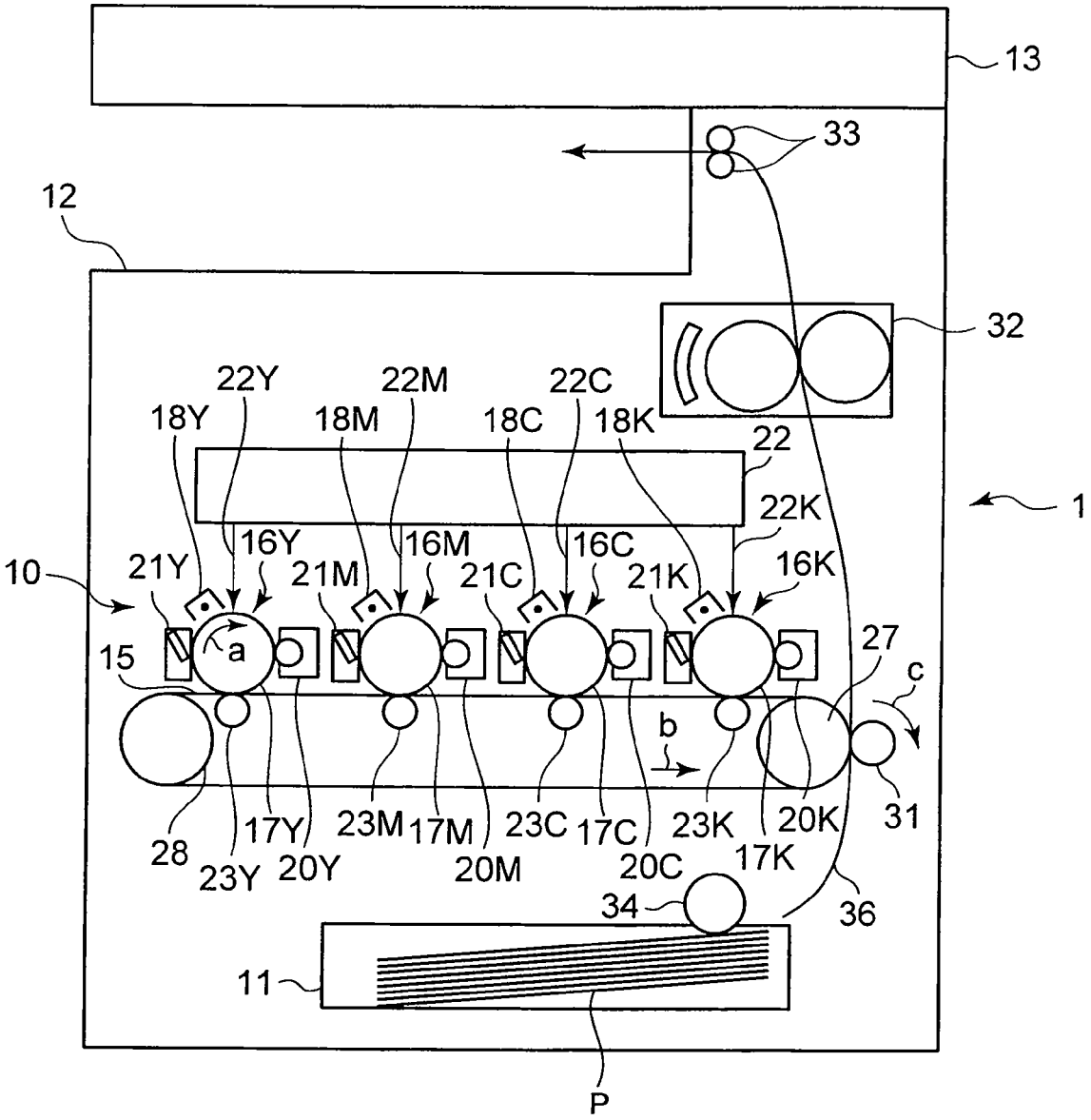
FIG. 1 is a schematic structural view showing an MFP in which a fuser is mounted of a first embodiment.

FIG. 1 is a schematic structural view showing a color MFP (Multi Functional Peripheral) 1 as a tandem-type image forming apparatus including a fuser of a first embodiment. The MFP 1 includes a printer section 10 as an image forming part, a paper feed part 11, a paper discharge part 12 and a scanner 13. The printer section 10 includes four sets of image forming stations 16Y, 16M, 16C and 16K for Y (yellow), M (magenta), C (cyan) and K (black) arranged in parallel along an intermediate transfer belt 15. The image forming stations 16Y, 16M, 16C and 16K respectively include photoconductive drums 17Y, 17M, 17C and 17K.

The image forming stations 16Y, 16M, 16C and 16K respectively include chargers 18Y, 18M, 18C and 18K, developing devices 20Y, 20M, 20C and 20K, and photoreceptor cleaners 21Y, 21M, 21C and 21K around the photoconductive drums 17Y, 17M, 17C and 17K rotating in an arrow a direction. The printer section 10 includes a laser exposure device 22 constituting an image forming unit.

The laser exposure device 22 irradiates laser beams 22Y, 22M, 22C and 22K corresponding to the respective colors to the photoconductive drums 17Y, 17M, 17C and 17K. The laser exposure device 22 irradiates the laser beams and forms electrostatic latent images on the respective photoconductive drums 17Y, 17M, 17C and 17K.

The printer section 10 includes a backup roller 27 and a driven roller 28 to support the intermediate transfer belt 15, and the intermediate transfer belt 15 runs in an arrow b direction. The printer section 10 includes primary transfer rollers 23Y, 23M, 23C and 23K at positions opposite to the photoconductive drums 17Y, 17M, 17C and 17K across the intermediate transfer belt 15.

The primary transfer rollers 23Y, 23M, 23C and 23K primarily transfer and sequentially superimpose toner images formed on the photoconductive drums 17Y, 17M, 17C and 17K onto the intermediate transfer belt 15. The photoreceptor cleaners 21Y, 21M, 21C and 21K respectively remove toners remaining on the photoconductive drums 17Y, 17M, 17C and 17K after the primary transfer.

The printer section 10 includes a secondary transfer roller 31 at a position opposite to the backup roller 27 across the intermediate transfer belt 15. The secondary transfer roller 31 is driven by the intermediate transfer belt 15 and rotates in an arrow c direction. In the printer section 10, a sheet P is taken out from the paper feed part 11 by a pickup roller 34, and the sheet P is fed to the position of the secondary transfer roller 31 along a conveyance path 36 in synchronization with a timing when the toner images of the intermediate transfer belt 15 reach the position of the secondary transfer roller 31. At the time of secondary transfer, the printer section 10 forms a transfer bias at a nip between the intermediate transfer belt 15 and the secondary transfer roller 31, and collectively secondarily transfers the toner images of the intermediate transfer belt 15 onto the sheet P.

In the printer section 10, the toner images are fixed to the sheet P by a fusing unit 32 as a fuser, and the sheet P is discharged to the paper discharge part 12 by a paper discharge roller pair 33.

The image forming apparatus is not limited to a tandem type, and the number of developing devices is not limited. The image forming apparatus may directly transfer a toner image from a photoreceptor to a recording medium.

Figure 2:
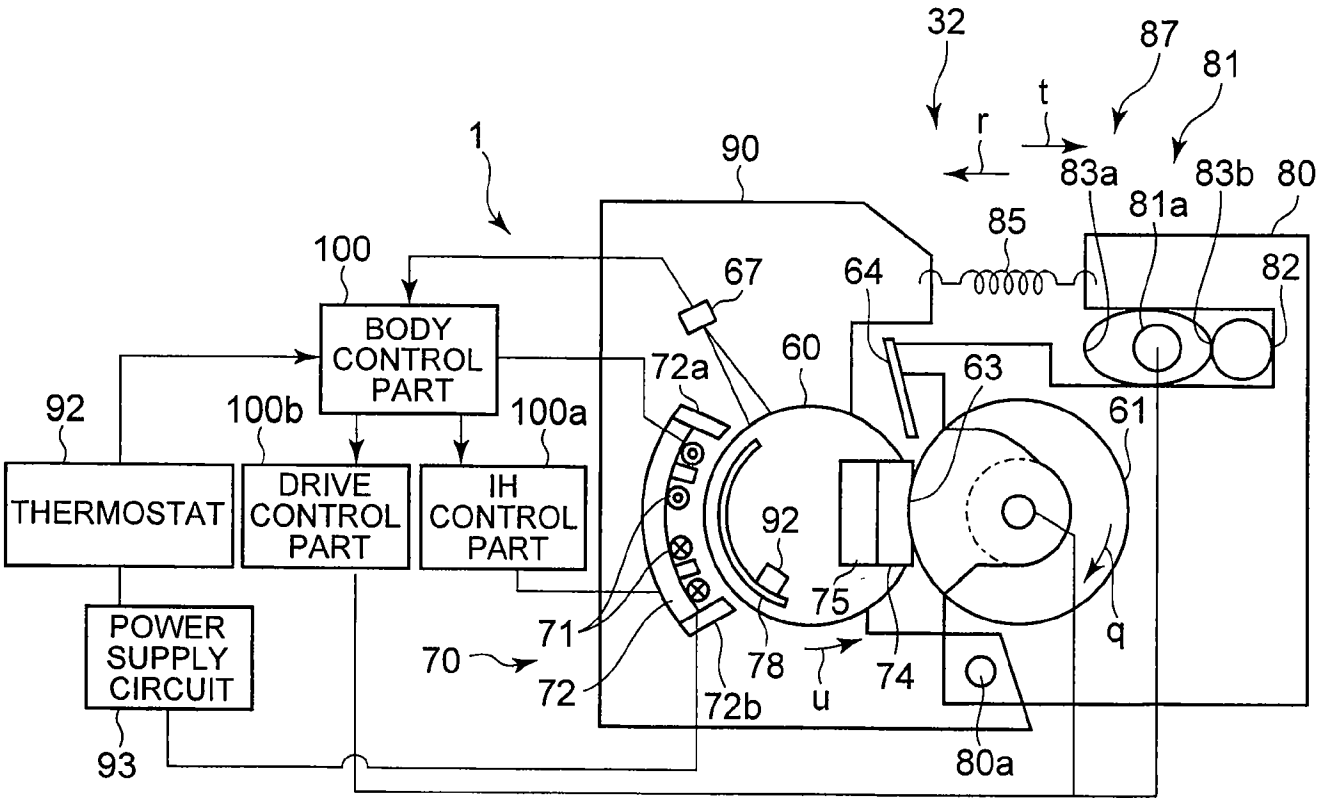
FIG. 2 is a schematic structural view in which a fuser unit is seen from side and is a schematic block diagram mainly showing the control of the fusing unit of the first embodiment.
Figure 3:
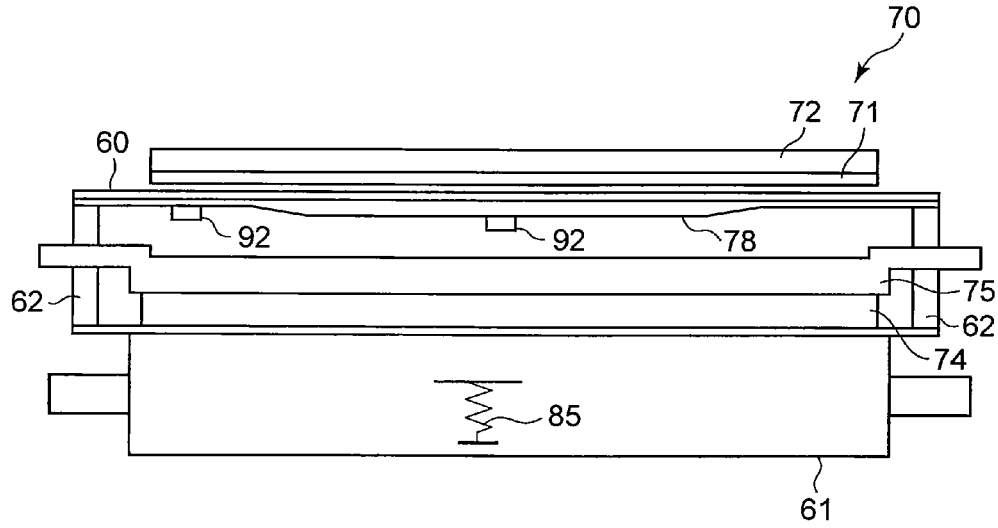
FIG. 3 is a schematic explanatory view showing a fusing belt and a press roller of the first embodiment.

Next, the fusing unit 32 will be described in detail. As shown in FIG. 2 and FIG. 3, the fusing unit 32 includes a fusing belt 60 as a heat generating part, a press roller 61 as a pressure part, an induced current generating coil (hereinafter abbreviated to an IH coil) 70 as an induced current generating part, a nip forming member 74, a heat equalizing plate 78 including a magnetic shunt metal layer 78*a* as a magnetic shunt metal member, and a non-contact thermopile infrared temperature sensor 67. The fusing unit 32 includes a peeling plate 64 as a peeling member at a discharge side of the sheet P with respect to a nip 63 on the periphery of the fusing belt 60.

Figure 4:
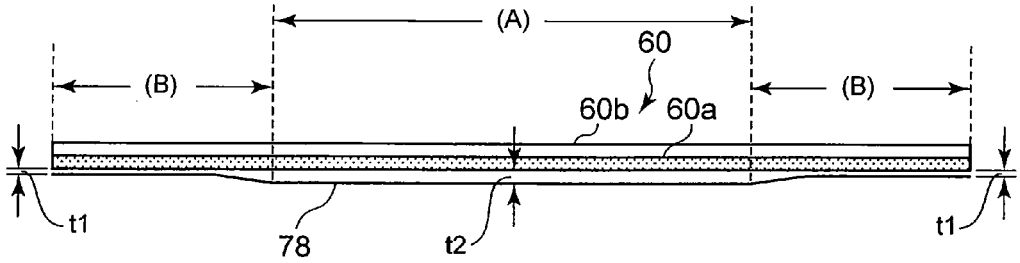
FIG. 4 is a schematic explanatory view showing a gap between the fusing belt and a heat equalizing plate of the first embodiment.

The fusing belt 60 includes a multi-layer structure. For example, as shown in FIG. 4, the fusing belt 60 includes a release layer 60*b* having a thickness of 30 μm and made of fluorine resin such as, for example, PFA resin, on a surface of a heat generating layer 60*a* having a thickness of, for example, 40 μm and made of nickel (Ni). A structure of the fusing belt is not limited. The fusing belt has only to include the heat generating layer, and an elastic layer may be disposed between the heat generating layer and the release layer. The thickness of the fusing belt is not limited. The heat generating layer may be made of nonmagnetic metal such as stainless, aluminum (Al), copper (Cu), silver (Ag) or composite material of stainless and aluminum. Flanges 62 support both sides of the fusing belt 60. The fusing belt 60, together with the flanges 62, is driven by the press roller 61 or drive independently.

The nip formation member 74 is formed of, for example, heat resistant silicone sponge or silicone rubber, and includes a release layer of, for example, fluorine resin on a surface. A stay 75 supports the nip formation member 74, and fixes the nip formation member 74 in the inside of the fusing belt 60.

The press roller 61 includes, for example, a heat resistant silicone sponge or silicone rubber layer around a core metal, and includes a release layer made of fluorine resin such as, for example, PFA resin on a surface. A press roller frame 80 to support the press roller 61 rotates around a fulcrum 80*a* with respect to a fusing belt frame 90 to support the fusing belt 60. The press roller 61 includes a pressure changing mechanism 87 to adjust the pressing force of the press roller 61 to the nip formation member 74. The pressure changing mechanism 87 includes a cam 81, a bearing 82 and a pressure spring 85. The pressure spring 85 presses the press roller 61 in an arrow r direction.

At the time of use of the fusing unit 32, a cam surface 83*b* close to a rotation center 81*a* contacts the bearing 82, and the cam 81 of the pressure changing mechanism 87 presses the press roller 61 to the nip formation member 74 at a high pressure by the pressure spring 85. If the fusing unit 32 is not used, in the cam 81, a cam surface 83*a* remote from the rotation center 81*a* contacts the bearing 82. The press roller frame 80 rotates in an arrow t direction, reduces the pressure of the press roller 61 to the nip formation member 74, and prevents permanent deformation of the press roller 61.

The press roller frame 80 fixes and supports the peeling plate 64. At the time of peeling, the tip of the peeling plate 64 approaches the fusing belt 60 along the nip formation member 74 squashed by the high pressure of the press roller 61 and certainly peels the sheet P. If the fusing unit 32 is not used, the press roller 61 reduces the pressure to the nip formation member 74, and the nip formation member 74 which deformed by pressure is restored. When the nip formation member 74 is restored, the peeling plate 64 rotates in the arrow t direction by the press roller frame 80 and separates from the nip formation member 74. When the nip formation member 74 is restored, the tip of the peeling plate 64 does not contact the fusing belt 60.

Figure 5:
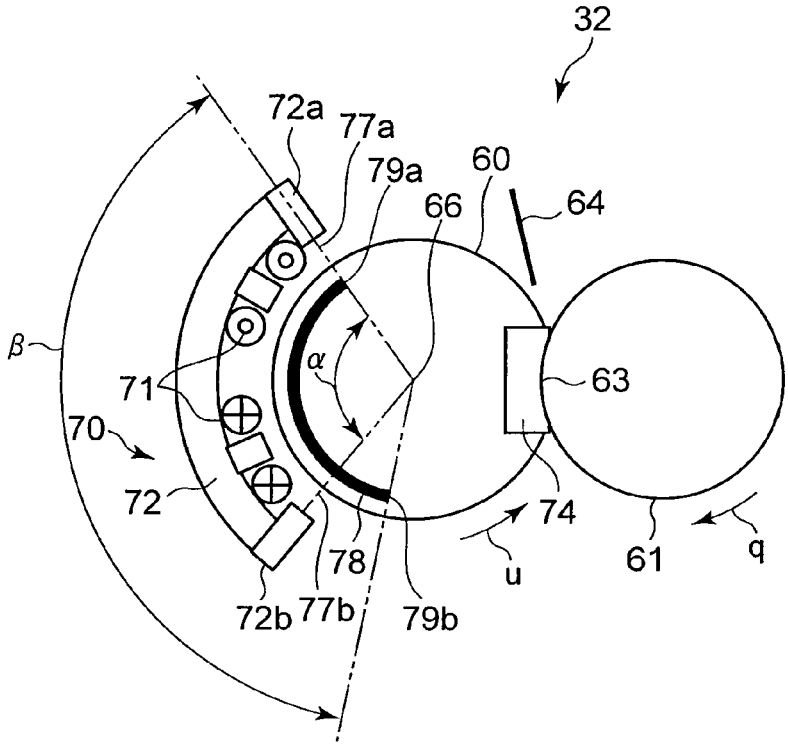
FIG. 5 is a schematic explanatory view showing the arrangement of an IH coil and the heat equalizing plate of the first embodiment.

As shown in FIG. 5, the IH coil 70 includes a coil 71 and a magnetic core 72 to intensify the magnetic field of the coil 71. The magnetic core 72 includes an upstream core 72*a* at an upstream end along a rotation direction of an arrow u direction of the fusing belt 60, and includes a downstream core 72*b* at a downstream end along the rotation direction of the arrow u direction of the fusing belt 60. A magnetic flux generation region (heating region) by excitation of the IH coil 70 in the rotation direction of the fusing belt 60 is determined by the upstream core 72*a* and the downstream core 72*b*. With respect to the magnetic flux generating region of the IH coil 70, the upstream core 72*a* determines a magnetic flux generation upstream end 77*a* and the downstream core 72*b* determines a magnetic flux generation downstream end 77*b*.

As the coil 71, for example, a litz wire is used in which plural copper rods coated with heat resistant polyamide-imide as insulating material are bundled. When a high frequency current is applied to the coil 71 to generate a magnetic flux, an eddy current is generated in the heat generating layer 60*a* of the fusing belt 60. Joule heat is generated by the eddy current and the resistance value of the heat generating layer 60*a*, and the surface of the fusing belt 60 is heated over the whole length in the longitudinal direction.

Figure 6:
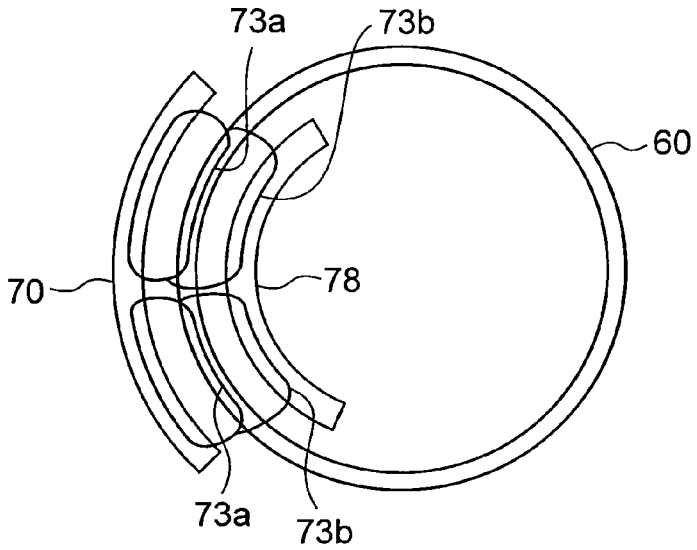
FIG. 6 is a schematic explanatory view showing a magnetic path of the IH coil of the first embodiment.

In order to enable quick temperature rise, the heat capacity of the heat generating layer 60*a* of the fusing belt 60 is made low and the thickness thereof is made thin. The thickness of the heat generating layer 60*a* of the fusing belt 60 is thinner than a skin depth at a frequency applied to the IH coil 70. As shown in FIG. 6, the magnetic flux of the IH coil 70 is induced in the heat generating layer 60*a* and forms a first magnetic path 73*a*. Further, the magnetic flux passes trough the thin heat generating layer 60*a*, is induced in the heat equalizing plate 78 arranged inside the fusing belt 60, and forms a second magnetic path 73*b*.

The heat equalizing plate 78 is formed into an arc shape along the inner peripheral surface of the fusing belt 60 while gaps t1 and t2 are formed between the heat equalizing plate and the inner peripheral surface of the fusing belt 60. Both ends of the heat equalizing plate 78 are supported by the flanges 62, and are fixed inside the fusing belt 60. The function of the heat equalizing plate 78 is changed at the Curie temperature at which the magnetic shunt metal layer 78*a* changes from a ferromagnetic material to a paramagnetic material. If the temperature of the magnetic shunt metal layer 78*a* does not reach the Curie temperature, the heat equalizing plate induces the magnetic flux from the IH coil 70 and generates heat, and further accelerates the quick temperature rise of the fusing belt 60. If the temperature of the magnetic shunt metal layer 78*a* reaches the Curie temperature, the heat equalizing plate 78 reduces the magnetic flux from the IH coil 70, and prevents abnormal heat generation of the fusing belt 60. For example, if the heat equalizing plate 78 is made of Fe—Ni alloy (Permalloy), the heat equalizing plate 78 has a reversible property, and returns to the ferromagnetic state if the temperature is reduced.

Figure 7:
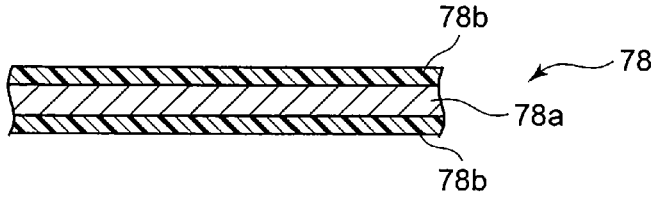
FIG. 7 is a partial sectional view showing the heat equalizing plate of the first embodiment.

As shown in FIG. 7, the heat equalizing plate 78 includes, for example, release layers 78*b* having a thickness of 0.03 mm on both surfaces of a magnetic shunt metal layer 78*a* having a thickness of 0.15 mm. The magnetic shunt metal layer 78*a* is formed of, for example, Fe—Ni alloy (Permalloy) having a Curie temperature of 200° C. The magnetic shunt metal layer 78*a* is not limited to the Fe—Ni alloy. The magnetic shunt metal layer 78*a* may be made of any material as long as the Curie temperature at which the material changes from a ferromagnetic material to a paramagnetic material is higher than the fusing temperature of toner and not higher than the upper temperature limit of the fusing belt 60, for example, about 200° C.

As the release layer 78*b*, a material having a low friction coefficient and high heat resistance, for example, PFA resin is used. Since the friction coefficient of the release layer 78*b* is low, even if the heat equalizing plate 78 contacts the inner peripheral surface of the fusing belt 60, the occurrence of drive load on the fusing belt 60 is prevented. The heat equalizing plate 78 supports a thermostat 92 on a side opposite to a side facing the fusing belt 60. The release layer 78*b* keeps the gap between the magnetic shunt metal layer 78*a* and the thermostat 92. The thermostat 92 detects abnormal heat generation of the fusing unit 32, and cuts off power supply to the IH coil 70. The thickness of the heat equalizing plate 78 is not limited.

The heat equalizing plate 78 formed into the arc shape along the inner peripheral surface of the fusing belt 60 has, for example, an arc shape whose center is a rotation center 66 of the fusing belt 60. For example, a first angle between a line connecting the rotation center 66 of the fusing belt 60 and the magnetic flux generation upstream end 77*a* of the IH coil 70 and a line connecting the rotation center and the magnetic flux generation downstream end 77*b* of the IH coil 70 is made an angle $\alpha$ (magnetic flux generation angle of the IH coil 70 at the rotation center 66). A second angle between a line connecting the rotation center 66 of the fusing belt 60 and an upstream side end 79*a* of the heat equalizing plate 78 in the rotation direction of the fusing belt 60 and a line connecting the rotation center 66 and a downstream side end 79*b* of the heat equalizing plate 78 is made an angle $\beta$ (center angle of the arc-shaped heat equalizing plate 78). The center angle $\beta$ of the arc shape is made larger than the angle $\alpha$ as the magnetic flux generation angle of the IH coil 70, so that the heat equalizing plate 78 prevents to leak the magnetic flux of the IH coil 70 passing through the fusing belt 60 to the surrounding of the heat equalizing plate 78.

In the longitudinal direction of the fusing belt 60 perpendicular to the rotation direction of the fusing belt 60, the size of the gap between the heat equalizing plate 78 and the fusing belt 60 varies. As shown in FIG. 4, in the longitudinal direction of the fusing belt 60, in a center region (A) of the fusing belt 60 as a first paper passing region, the gap between the heat equalizing plate 78 and the fusing belt 60 is set to a first gap t2. In the longitudinal direction of the fusing belt 60, in a side region (B) as a second paper passing region, the gap between the heat equalizing plate 78 and the fusing belt 60 is set to a second gap t1 narrower than the first gap t2.

For example, if the fusing belt 60 fixes the sheet P of JIS standard "A4" vertical size (297 mm) at the maximum, the center region (A) is made, for example, JIS standard "A4" horizontal size (210 mm). The second gap t1 is set to, for example, $t1 \leq 1.5 \times t2$. The second gap t1 is preferably, for example, 2 mm or less. In the image forming apparatus, a sheet is not necessarily conveyed while aligned to the center. For example, if a sheet is conveyed while aligned to the end, in the longitudinal direction of the fusing belt, the rear side of the image forming apparatus is made a base point, and a region where a small size sheet passes is set to a first region, and the remaining region on the front side may be set to a second paper passing region.

The non-contact thermopile infrared temperature sensor 67 detects the temperature of the fusing belt 60, and inputs the detection result to a body control part 100 to control the MFP 1. The body control part 100 controls an IH control part 100*a* to control application of high frequency current to the IH coil 70 and a drive control part 100*b* to control pressure adjustment or rotation driving of the press roller 61.

If printing starts, the drive control part 100*b* controls rotation of the cam 81 of the fusing unit 32, and causes the cam surface 83*b* close to the rotation center 81*a* of the cam 81 to contact the bearing 82. The press roller frame 80 rotates in the arrow r direction by the spring force of the pressure spring 85. The press roller 61 presses the nip formation member 74 at high pressure. The peeling plate 64 supported by the press roller frame 80 rotates in the arrow r direction, and its tip approaches the fusing belt 60. The drive control part 100*b* rotates the press roller 61 in an arrow q direction, and the fusing belt 60 is rotated or independently rotated in an arrow u direction.

The IH control part 100*a* excites the coil 71. The IH control part 100*a* feedback controls the IH coil 70 from the detection result of the infrared temperature sensor 67, and keeps the fusing belt 60 at fusing temperature. The magnetic flux of the coil 71 generates the eddy current in the heat generating layer 60*a* of the fusing belt 60 and heats the fusing belt 60. Further, the magnetic flux of the coil 71 passing through the heat generating layer 60*a* generates the eddy current in the magnetic shunt metal layer 78*a* of the heat equalizing plate 78, and heats the heat equalizing plate 78.

At the time of heating start of the fusing belt 60, the heat of the heat equalizing plate 78 is conducted to the fusing belt 60 through the gap, and accelerates the quick temperature rise of the fusing belt 60. The sheet P on which a toner image is formed comes in close contact with the fusing belt 60 while passing through the nip 63, and the toner image is fixed. The peeling plate 64 peels the sheet P, which passed through the nip 63, from the fusing belt 60.

If the width of the sheet P is equal to the whole length of the fusing belt 60 in the longitudinal direction, the whole length of the fusing belt 60 in the longitudinal direction contacts the sheet P during fixation. During fixation, the temperature of the fusing belt 60 is almost uniformly reduced over the whole length in the longitudinal direction, and there is no fear that a specific region abnormally generates heat.

If the sheet P has a small size, if the fusing operation is continued, although the temperature of the paper passing region of the sheet P is reduced in the longitudinal direction of the fusing belt 60, the temperature of the sheet non-passing region gradually increases. For example, if the sheets P having "A4" lateral size (210 mm) width are continuously fixed, in the center region (A) of the fusing belt 60 which becomes the paper passing region, the temperature is absorbed by the passage of the sheet P. However, in the side region (B) of the fusing belt 60 which becomes the paper non-passing region, the temperature gradually increases. If the temperature in the side region (B) increases, and the temperature of the magnetic shunt metal layer 78*a* of the heat equalizing plate 78 reaches the Curie temperature, the magnetic flux from the IH coil 70 is quickly decreased in the side region (B). In the side region (B), the fusing belt 60 and the magnetic shunt metal layer 78*a* stop self heat generation, and abnormal heat generation in the side region (B) of the fusing belt 60 is prevented.

In the side region (B) of the fusing belt 60, the gap between the heat equalizing plate 78 and the fusing belt 60 is the second gap t1, and the heat equalizing plate 78 is close to the fusing belt 60. Accordingly, thermal conductivity from the fusing belt 60 to the heat equalizing plate 78 is high in the side region (B). If the temperature in the side region (B) of the fusing belt 60 increases while the small size sheets P are continuously fixed, heat of the fusing belt 60 in the side region (B) is quickly conducted to the heat equalizing plate 78 close to the fusing belt 60. Increased temperature in the side region (B) of the fusing belt 60 immediately increases the temperature of the magnetic shunt metal layer 78*a*.

The heat equalizing plate 78 is close to the fusing belt 60, so that the timing when the magnetic shunt metal layer 78*a* in the side region (B) of the fusing belt 60 reaches the Curie temperature is quickened. The self heat generation in the side region (B) as the paper non-passing region is stopped at the early timing, and the abnormal heat generation in the side region (B) is efficiently prevented. If the side region (B) of the fusing belt 60 abnormally generates heat, the print operation must be waited until the temperature of the side region (B) is reduced. The timing when the magnetic shunt metal layer 78*a* reaches the Curie temperature is quickened, and the occurrence of the wait mode of the fusing unit 32 is prevented.

In the center region (A) of the fusing belt 60, the gap between the heat equalizing plate 78 and the fusing belt 60 is the first gap t2, and the heat equalizing plate 78 is somewhat separate from the fusing belt 60. Thus, as compared with the side region (B), the thermal conductivity from the fusing belt 60 to the heat equalizing plate 78 in the center region (A) is reduced. The timing when the temperature of the magnetic shunt metal layer 78*a* in the center region (A) of the fusing belt 60 increases by the heat conduction from the fusing belt 60 is delayed, and it is prevented that the temperature of the magnetic shunt metal layer 78*a* in the center region (A) reaches the Curie temperature during fixation. The abrupt reduction in temperature reducing of the center region (A) of the fusing belt 60 due to the decrease of the magnetic flux is prevented, and the center region (A) as the paper passing region of the fusing belt 60 is kept at the fusing temperature.

If printing is ended, the drive control part 100*b* rotates and controls the cam 81 of the fusing unit 32, and causes the cam surface 83*a* remote from the rotation center 81*a* of the cam 81 to contact the bearing 82. The press roller frame 80 rotates in the arrow t direction against the spring force of the pressure spring 85. The press roller 61 reduces the pressure to the nip formation member 74. The nip formation member 74 which deformed by pressure is restored, and the peeling plate 64 moves in the arrow t direction by the rotation of the press roller frame 80 and separates from the fusing belt 60.

There is a case where during printing, for example, the fusing belt 60 or the heat equalizing plate 78 is heated, and the fusing unit 32 abnormally generates heat. If the fusing unit 32 abnormally generates heat, the thermostat 92 is turned off, power supply from a power supply circuit 93 to the IH coil 70 is cut off, and the abnormal heat generation of the fusing unit 32 is stopped.

According to the first embodiment, the gap between the heat equalizing plate 78 including the magnetic shunt metal layer 78*a* and the fusing belt 60 is made such that the second gap t1 in the side region (B) is narrower than the first gap t2 in the center region (A). If the small size sheets P are continuously fixed, the temperature increases in the side region (B) of the fusing belt 60 is quickly heat-conducted to the magnetic shunt metal layer 78*a* in the side region (B), and the timing when the magnetic shunt metal layer 78*a* in the side region (B) reaches the Curie temperature is quickened. The magnetic shunt metal layer 78*a* in the side region (B) reaches the Curie temperature, and the self heat generation of the fusing belt 60 and the magnetic shunt metal layer 78*a* in the side region (B) is stopped, to prevent abnormal heat generation of the fusing belt 60 and the fusing unit 32. The occurrence of the wait mode of the fusing unit 32, which is caused if the side region (B) of the fusing belt 60 abnormally generates heat, is prevented, and the performance of the MFP 1 for printing different sizes of paper is improved.

In the center region (A) of the fusing belt 60, heat conduction from the fusing belt 60 to the magnetic shunt metal layer 78*a* is reduced, and the timing when the magnetic shunt metal layer 78*a* in the center region (A) reaches the Curie temperature by the heat conduction from the fusing belt 60 is delayed. It is prevented that the center region (A) reaches the Curie temperature during fixation, the abrupt reduction in temperature in the center region (A) of the fusing belt 60 is prevented, and the performance of the MFP 1 is improved.

Second Embodiment

Next, a second embodiment will be described. In the second embodiment, slits are formed in a magnetic shunt metal member. In the second embodiment, the same component as the component described in the first embodiment is denoted by the same reference numeral and its detailed description is omitted.

Figure 8:
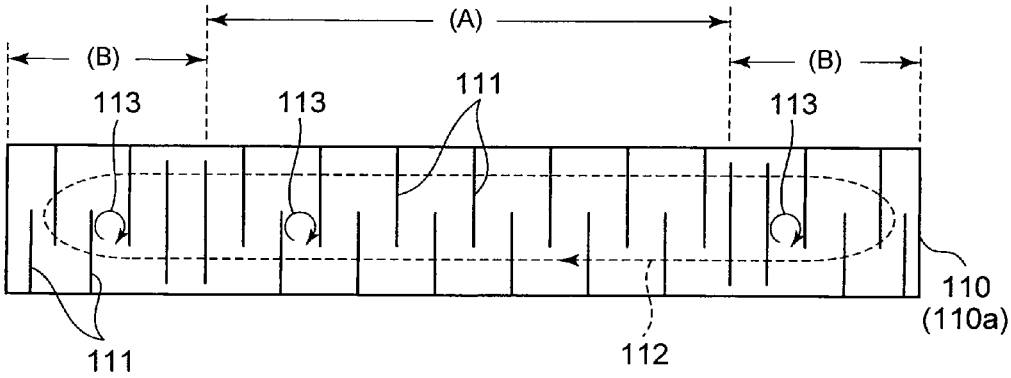
FIG. 8 is a schematic plan view showing a heat equalizing plate of a second embodiment.

As shown in FIG. 8, a heat equalizing plate 110 including a magnetic shunt metal layer 110*a* of the second embodiment includes slits 111 at specified intervals throughout the entire area. The slits 111 are formed by, for example, press-working the heat equalizing plate 110. If the heat equalizing plate 110 does not include the slits 111, as indicated by a dotted line in FIG. 8, the heat equalizing plate 110 generates a large eddy current 112 throughout the whole area of the heat equalizing plate 110 by magnetic flux from an IH coil 70. Thus, if the heat equalizing plate 110 does not include the slits 111, there is a fear that the whole area of the heat equalizing plate 110 reaches the Curie temperature by self heat generation caused by the large eddy current 112. If the whole area of the heat equalizing plate 110 reaches the Curie temperature, there is a fear that in the longitudinal direction of a fusing belt 60, the temperature of a region where fixation is being performed is also abruptly lowered, and fusing can not be performed.

If the heat equalizing plate 110 is provided with the slits 111, as shown by a solid line in FIG. 8, small eddy currents 113 are generated between the slits 111 in the heat equalizing plate 110 by the magnetic flux from the IH coil 70. Since the eddy current generated in the heat equalizing plate 110 is small irrespective of the magnetic flux from the IH coil 70, self heat generation of the heat equalizing plate 110 by the eddy current is small, and it is prevented that the temperature of the heat equalizing plate 110 reaches the Curie temperature by the self heat generation. Further, since the self heat generation of the heat equalizing plate 110 is small, the increased temperature of the inside of the fusing belt 60 is prevented.

Since the self heat generation of the heat equalizing plate 110 is suppressed to be low, the increased temperature due to the heat conduction from the fusing belt 60 is more reflected on the heat equalizing plate 110. Similarly to the first embodiment, in the longitudinal direction of the fusing belt 60, a gap between the heat equalizing plate 110 and the fusing belt 60 in a center region (A) is set to a first gap t2, and a gap between the heat equalizing plate 110 and the fusing belt 60 in a side region (B) is set to a second gap t1 narrower than the first gap t2. Accordingly, in the side region (B) close to the fusing belt 60, the increased temperature of the fusing belt 60 is quickly conducted to the heat equalizing plate 110. If small size sheets P are continuously fixed and the temperature in the side region (B) of the fusing belt 60 increases, the heat of the fusing belt 60 in the side region (B) is quickly reflected on the increased temperature of the magnetic shunt metal layer 110*a*. The magnetic shunt metal layer 110*a* in the side region (B) of the fusing belt 60 reaches the Curie temperature at an early timing, and the prevention of the increased temperature of the fusing belt 60 is advanced.

In the center region (A) of the fusing belt 60, since the heat equalizing plate 110 is somewhat separate from the fusing belt 60, thermal conductivity from the fusing belt 60 to the heat equalizing plate 110 is reduced. The timing when the temperature of the magnetic shunt metal layer 110*a* in the center region (A) of the fusing belt 60 is increased by the heat conduction from the fusing belt 60 is delayed, and it is prevented that the magnetic shunt metal layer 110*a* in the center region (A) reaches the Curie temperature during fixation. Abrupt reduction in temperature of the center region (A) of the fusing belt 60 is prevented, and the center region (A) of the fusing belt 60 is kept at fusing temperature.

According to the second embodiment, similarly to the first embodiment, if small size sheets P are continuously fixed, the increased temperature in the side region (B) of the fusing belt 60 is quickly conducted to the magnetic shunt metal layer 110*a*, and the timing when the magnetic shunt metal layer 110*a* in the side region (B) reaches the Curie temperature is quickened. If the magnetic shunt metal layer 110*a* in the side region (B) reaches the Curie temperature, the self heat generation of the fusing belt 60 and the magnetic shunt metal layer 110*a* in the side region (B) is stopped, and the abnormal heat generation of the fusing belt 60 and the fusing unit 32 is prevented. The occurrence of the wait mode of the fusing unit 32 is prevented and the performance of the MFP 1 is improved. In the center region (A) of the fusing belt 60, the heat conduction from the fusing belt 60 to the magnetic shunt metal layer 110*a* is reduced to delay the timing when the magnetic shunt metal layer 110*a* in the center region (A) reaches the Curie temperature by the heat conduction from the fusing belt 60. It is prevented that the center region (A) reaches the Curie temperature during fixation, abrupt reduction in temperature of the center region (A) of the fusing belt 60 is prevented, and the performance of the MFP 1 is improved.

According to the second embodiment, the heat equalizing plate 110 is provided with the slits. The eddy current 113 generated in the heat equalizing plate 110 is reduced irrespective of the magnetic flux from the IH coil 70. Accordingly, the self heat generation of the heat equalizing plate 110 by the eddy current is suppressed, and it is certainly prevented that the whole area of the heat equalizing plate 110 reaches the Curie temperature by the self heat generation, the reduction in temperature of the fusing region of the fusing belt 60 during fixation is prevented certainly, and the performance of the MFP 1 is improved.

Third Embodiment

Next, a third embodiment will be described. In the third embodiment, in a longitudinal direction of a heat generating part, magnetic shunt metal members different in Curie temperature are used in a center region and a side region. In the third embodiment, the same component as the component described in the first embodiment is denoted by the same reference numeral and its detailed description is omitted.

Figure 9:
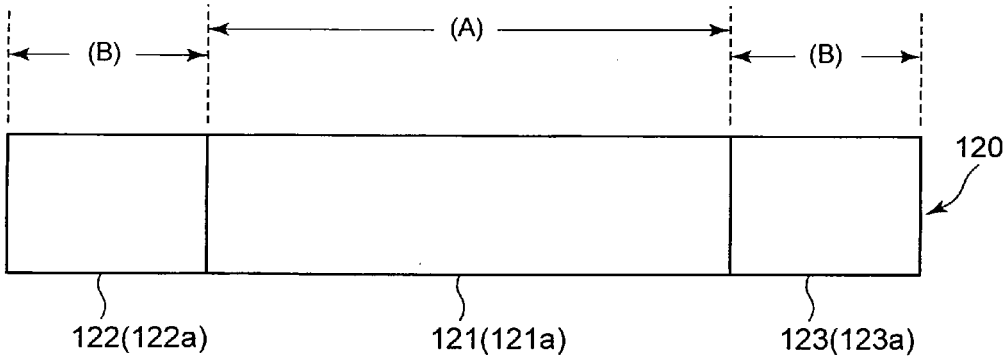
FIG. 9 is a schematic plan view showing a heat equalizing plate of a third embodiment.

As shown in FIG. 9, in the third embodiment, a heat equalizing plate 120 is divided into a center heat equalizing plate 121 and side heat equalizing plates 122 and 123. The center heat equalizing plate 121 includes a magnetic shunt metal layer 121*a* made of MS 220 (made by Neomax Material Co., Ltd.) which is a magnetic shunt metal member whose Curie temperature is 220° C. The side heat equalizing plates 122 and 123 respectively include magnetic shunt metal layers 122*a* and 123*a* made of MS 190 (made by Neomax Material Co., Ltd.) which is a magnetic shunt metal member whose Curie temperature is 190° C.

Accordingly, in the heat equalizing plate 120, if the center heat equalizing plate 121 in the center region (A) reaches 220° C., the magnetic flux from the IH coil 70 is abruptly reduced. If the side heat equalizing plates 122 and 123 in the side regions (B) reach 190° C., the magnetic flux from the IH coil 70 is abruptly reduced.

Similarly to the first embodiment, in the longitudinal direction of the fusing belt 60, a gap between the center heat equalizing plate 121 and the fusing belt 60 in the center region (A) is set to a first gap t2, and a gap between the side heat equalizing plate 122, 123 and the fusing belt 60 in the side region (B) is set to a second gap t1 narrower than the first gap t2. In the side region (B) close to the fusing belt 60, increased temperature of the fusing belt 60 is quickly conducted to the heat equalizing plate 110.

If small size sheets P are continuously fixed and the temperature in the side regions (B) of the fusing belt 60 increases, the heat of the fusing belt 60 in the side regions (B) is quickly conducted to the magnetic shunt metal layers 122*a* and 123*a*. Further, since the magnetic shunt metal layers 122*a* and 123*a* in the side regions (B) of the fusing belt 60 reach the Curie temperature at 190° C., abnormal heat generation of the fusing belt 60 is prevented while the temperature in the side regions (B) of the fusing belt 60 is relatively low.

In the center region (A) of the fusing belt 60, the center heat equalizing plate 121 is somewhat separate from the fusing belt 60, and the timing when the magnetic shunt metal layer 121*a* of the center heat equalizing plate 121 reaches the Curie temperature by the heat conduction is delayed. Further, since the Curie temperature of the magnetic shunt metal member 121*a* in the center region (A) of the fusing belt 60 is as high as 220° C., even if the temperature in the center region (A) of the fusing belt 60 slightly increases and the temperature of the magnetic shunt metal layer 121*a* of the center heat equalizing plate 121 increases it is prevented that the magnetic shunt metal layer 121*a* reaches the Curie temperature. Even if the temperature in the center region (A) of the fusing belt 60 slightly increases, abrupt reduction in temperature in the center region (A) of the fusing belt 60 is prevented, and the fusing region of the fusing belt 60 is kept at fusing temperature.

According to the third embodiment, when small size sheets P are continuously fixed, the magnetic shunt metal layers 122*a* and 123*a* are quickly heated to the Curie temperature while the temperature in the side region (B) is relatively low, magnetic permeabilities of the fusing belt 60 and the magnetic shunt metal layers 122*a* and 123*a* in the side region (B) are decreased, and the abnormal heat generation of the fusing belt 60 is prevented. On the other hand, in the center region (A) of the fusing belt 60, even if the temperature slightly increases, the magnetic shunt metal layer 121*a* does not reach the Curie temperature. Even if the temperature in the center region (A) of the fusing belt 60 slightly increases, desired fusing temperature is obtained, and the performance of the MFP 1 is improved.

According to at least one of the embodiments, even if small size sheets are continuously fixed, the increased temperature of the heat generating part in the paper non-passing region is quickly conducted to the magnetic shunt metal member. The timing when the magnetic shunt metal member in the paper non-passing region reaches the Curie temperature is quickened, the abnormal heat generation of the heat generating part is prevented, and the performance of the image forming apparatus is improved. In the paper passing region, heat conduction from the heat generating part to the magnetic shunt metal layer is reduced. The timing when the magnetic shunt metal layer in the paper passing region reaches the Curie temperature is delayed, it is prevented that the paper passing region reaches the Curie temperature during fixation, and the performance of the image forming apparatus is improved.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and their equivalents are intended to cover such forms of modifications as would fall within the scope and spirit of the invention.

What is claimed is:

1. A fuser comprising:

an endless heat transferring part including a conductive layer and first and second paper passing regions;

an induced current generating part to heat the conductive layer by electromagnetic induction; and a magnetic shunt metal member that is located at a side opposite to the induced current generating part across the heat transferring part, forms a first gap between the magnetic shunt metal member and the heat transferring part in the first paper passing region of the heat transferring part, forms a second gap, which is different from the first gap in size, between the magnetic shunt metal member and the heat transferring part in the second paper passing region of the heat transferring part different from the first paper passing region, and includes a release layer on a surface.

2. The apparatus of claim 1, wherein the first paper passing region, and not the second paper passing region, is a paper passing region of a recording medium having a small size, and the first and second paper passing regions are a paper passing region of a recording medium having a large size.

3. The apparatus of claim 1, wherein the first paper passing region is a center region of the heat transferring part, and the second paper passing region is a region at both sides of the center region.

4. The apparatus of claim 1, wherein a size of the second gap is narrower than a size of the first gap.

5. The apparatus of claim 1, wherein the magnetic shunt metal member includes a region wider than a heat transferring region of the heat transferring part provided by the induced current generating part.

6. The apparatus of claim 1, wherein the heat transferring part is a fusing belt, the fusing belt includes a nip formation member surrounded by the fusing belt to be pressed to a pressure part, the induced current generating part is an induced current generating coil in a vicinity of an outer periphery of the fusing belt, and the magnetic shunt metal member is also surrounded by the fusing belt.

7. The apparatus of claim 6, wherein a sectional shape of the magnetic shunt metal member is an arc shape including a center angle which is a second angle larger than a first angle between a line connecting a rotation center of the fusing belt and an upstream side magnetic flux generating end of the induced current generating coil and a line connecting the rotation center and a downstream side magnetic flux generating end of the induced current generating coil in a running direction of the fusing belt.

8. The apparatus of claim 1, wherein the magnetic shunt metal member includes a plurality of slits.

9. The apparatus of claim 1, wherein Curie point of the magnetic shunt metal member in the first paper passing region is different from Curie point of the magnetic shunt metal member in the second paper passing region.

10. An image forming apparatus comprising:

an image forming part to form an image on a recording medium;

an endless heat transferring part that includes a conductive layer, first and second paper passing regions and contacts the recording medium to fix the image to the recording medium;

an induced current generating part to heat the conductive layer by electromagnetic induction; and a magnetic shunt metal member that is located at a side opposite to the induced current generating part across the heat transferring part, forms a first gap between the magnetic shunt metal member and the heat transferring part in the first paper passing region of the heat transferring part, forms a second gap, which is different from the first gap in size, between the magnetic shunt metal member and the heat generating transferring part in the second paper passing region of the heat transferring part different from the first paper passing region, and includes a release layer on a surface.

11. The apparatus of claim 10, wherein the first paper passing region, and not the second paper passing region, is a paper passing region of a recording medium having a small size, and the first and second paper passing regions are a paper passing region of a recording medium having a large size.

12. The apparatus of claim 10, wherein the first paper passing region is a center region of the heat transferring part, and the second paper passing region is a region at both sides of the center region.

13. The apparatus of claim 10, wherein a size of the second gap is narrower than a size of the first gap.

14. The apparatus of claim 10, wherein the magnetic shunt metal member includes a region wider than a heat transferring region of the heat transferring part provided by the induced current generating part.

15. The apparatus of claim 10, wherein the heat transferring part is a fusing belt, the fusing belt includes a nip formation member inside of the fusing belt to be pressed to a pressure part, the induced current generating part is an induced current generating coil in a vicinity of an outer periphery of the fusing belt, and the magnetic shunt metal member is located inside the fusing belt.

16. The apparatus of claim 15, wherein a sectional shape of the magnetic shunt metal member is an arc shape including a center angle which is a second angle larger than a first angle between a line connecting a rotation center of the fusing belt and an upstream side magnetic flux generating end of the induced current generating coil and a line connecting the rotation center and a downstream side magnetic flux generating end of the induced current generating coil in a running direction of the fusing belt.

17. The apparatus of claim 10, wherein the magnetic shunt metal member includes a plurality of slits.

18. The apparatus of claim 10, wherein Curie point of the magnetic shunt metal member in the first paper passing region is different from Curie point of the magnetic shunt metal member in the second paper passing region.

* * * * *

UNITED STATES PATENT AND TRADEMARK OFFICE

CERTIFICATE OF CORRECTION

PATENT NO. : 8,718,525 B2
APPLICATION NO. : 13/293708
DATED : May 6, 2014
INVENTOR(S) : Kazuhiko Kikuchi It is certified that error appears in the above-identified patent and that said Letters Patent is hereby corrected as shown below:

In the Claims

Column 12, claim 10, line 27, delete “generating”.

Signed and Sealed this
Twenty-fifth Day of November, 2014

Michelle K. Lee

Michelle K. Lee
*Deputy Director of the United States Patent and Trademark Office*